US005203853A

United States Patent [19]

Caruso

[11] Patent Number: 5,203,853

[45] Date of Patent: Apr. 20, 1993

[54] LOCKING CHAIR TILT MECHANISM WITH TORSION BAR

[75] Inventor: Jerome Caruso, Lake Forest, Ill.

[73] Assignee: Herman Miller, Inc., Zeeland, Mich.

[21] Appl. No.: 763,654

[22] Filed: Sep. 18, 1991

[51] Int. Cl.[5] ..... A47C 3/00

[52] U.S. Cl. ..... 297/303; 248/394

[58] Field of Search ..... 297/304, 303, 302, 376, 297/317, 318, 320, 321, 322, 326, 327, 328, 329, 340, 300, 301, 285, 363, 313, 342, 343, 355; 248/575, 393, 394, 395, 397

[56] References Cited

U.S. PATENT DOCUMENTS 2,158,453 5/1939 Wood .
2,303,308 11/1942 McArthur ..... 297/342
2,429,017 10/1947 De Rose ..... 248/394
3,870,269 3/1975 Werner et al. ..... 248/394
4,099,775 7/1978 Mizelle .
4,304,384 12/1981 Cremer ..... 248/397
4,314,728 2/1982 Faiks .
4,375,301 3/1983 Pergler et al. .
4,390,206 6/1983 Faiks et al. .
4,432,582 2/1984 Wiesmann et al. .
4,438,898 3/1984 Knoblauch et al. .
4,451,085 5/1984 Franck et al. .
4,494,795 1/1985 Roossien et al. .
4,502,729 3/1985 Locher .
4,509,793 4/1985 Wiesmann et al. .
4,513,937 4/1985 Langmesser, Jr. et al. ..... 248/394
4,537,445 8/1985 Neuhoff .
4,653,806 3/1987 Willi .
4,668,012 5/1987 Locher .
4,695,093 9/1987 Suhr et al. .
4,707,029 11/1987 Korn .
4,718,726 1/1988 Estkowski et al. .
4,773,706 9/1988 Hinrichs .
4,776,633 10/1988 Knoblock et al. .
4,792,187 12/1988 Desanta .
4,805,865 2/1989 Goforth .
4,840,426 6/1989 Vogtherr et al. .
4,865,384 9/1989 Desanta .
4,889,385 12/1989 Chadwick et al. .
4,892,354 1/1990 Estkowski et al. .
4,979,778 12/1990 Shields .

*Primary Examiner*—James R. Brittain
*Assistant Examiner*—James M. Gardner
*Attorney, Agent, or Firm*—Varnum, Riddering, Schmidt & Howlett

[57] ABSTRACT

A locking chair tilt mechanism for a chair in which the backrest and rear seat portion tilt rearwardly and downwardly, and the front seat portion of the chair slides generally horizontally is disclosed. The chair is supported by a tilt mechanism mounted between the base and the chair. Front and rear support arms extend from the biasing member mounted on top of the base, to the chair frame. The front support arm is slidably and pivotably mounted to the chair-frame to create the horizontal sliding movement of the front portion of the chair. The locking mechanism mounts immediately adjacent the elongated opening and comprises a pivotable locking bar, a high pitch screw fixedly attached to said bar, a rack with a first set of teeth and a gripping member threadably mounted on said screw with a second set of teeth. The first and second set of teeth are selectively cooperable upon rotation of the locking bar and screw through movement of the threadably mounted gripping member.

24 Claims, 9 Drawing Sheets

LOCKING CHAIR TILT MECHANISM WITH TORSION BAR

BACKGROUND OF THE INVENTION

Field of the Invention

This invention relates to chairs with tilt mechanisms and, more particularly, to a tilt mechanism which incorporates a locking bar to selectively lock the chair in one of several tilted positions.

Description of Related Art

One problem present in a typical reclining chair is that as the backrest and rear seat portion of the chair recline, the front edge of the seat portion of the chair lifts as the chair is reclined from its upright position. This lifting movement places pressure on the underside of the occupant's thighs and may even lift the occupant's feet off the ground. To overcome this problem, chairs have been designed such that as the backrest of the chair is tilted downward and backward, the leading edge of the seat portion of the chair slides generally along a horizontal plane, or is lifted only slightly. Numerous examples of these chairs are seen in U.S. Pat. No. 4,432,582 to Wiesmann et al., U.S. Pat. No. 4,840,426 to Vogther et al., U.S. Pat. No. 4,695,093 to Suhr et al., U.S. Pat. No. 4,776,633 to Knoblock et al., U.S. Pat. No. 4,979,778 to Shields and U.S. Pat. No. 4,451,085 to Franck et al.

U.S. Pat. No. 4,668,012 to Locher and U.S. Pat. No. 4,653,806 to Willi are examples of chairs which accomplish the horizontal movement of the seat portion by incorporating a cantilevered arm which cooperates with an elongated opening at the seat portion of the chair. The arm extends from the chair base and is slidably mounted within the elongated opening. As the backrest reclines, the seat portion moves along a horizontal plane and is guided by the front arm. What is not shown for reclining chairs with such a front arm/elongated opening construction is a locking device to selectively lock the chair in one of several tilted positions.

SUMMARY OF INVENTION

The locking chair tilt mechanism according to the invention provides a locking device for selectively locking a chair in one of several tilted positions in which the seat portion moves generally along a horizontal plane as the chair is reclined.

The invention relates to a locking mechanism for a chair which comprises a base and a chair frame for supporting a seat and backrest. An elongated opening is incorporated in the frame near the front edge of the seat portion thereof. A tilt mechanism is mounted between the base and the chair frame for tilting movement of the seat and backrest relative to the base. The tilt mechanism includes means to bias the chair frame to an upright position and at least one front support arm which is fixedly mounted at a first end to the base. A second end of the front support arm is both slidably and pivotably mounted in the elongated opening of the frame. The locking mechanism is mounted between the front support arm and the chair frame to selectively lock the seat and backrest in one of several tilted positions.

Preferably, the locking mechanism comprises a lock bar pivotably mounted to either the front support arm or the chair frame and at least one engaging tooth on the locking bar. A rack, which is cooperable with the tooth, is mounted to the other of the front support arm or chair frame. The rack is adjacent the locking bar so that the engaging tooth selectively registrable with the rack to lock the front arm with respect to the chair frame.

Preferably, the bias means comprises a torsion bar which is mounted to the top of the base to resist the tilting movement of the seat and backrest relative to the base. The torsion bar comprises a first end which is fixedly attached to the base and second end which is coupled to the chair frame.

In a further embodiment, the bias means further comprises an inner sleeve which circumferentially surrounds the torsion bar. A bearing sleeve circumferentially surrounds the inner sleeve. An outer sleeve is fixedly attached to the base and circumferentially surrounds the bearing sleeve wherein the first end of the torsion bar is fixedly attached to the inner sleeve such that the second end of the torsion bar can rotate relative to the inner and outer sleeves.

In another embodiment, the tilt mechanism further comprises at least one back support arm between the base and the chair frame. Preferably the back support arm is mounted between the chair frame and the biasing means. A first end of the back support arm is fixedly mounted to the inner sleeve and a second end of the back support arm is pivotably mounted to the chair frame.

In a further embodiment, one end of the front support arm is fixedly attached to the outer sleeve.

In yet another embodiment, the tilt mechanism further comprises a tension control lever with is fixedly attached to the second end of the torsion bar. The tension control lever varies the tension of the bar necessary to tilt the seat and backrest relative to the base.

In a further embodiment, the locking mechanism comprises a lock bar pivotably mounted to either the front support arm or the chair frame and at least one engaging tooth on the locking bar. A complementary member, which is cooperable with the tooth, is mounted to the other of the front support arm or chair frame. The complementary member is adjacent the locking bar so that the engaging tooth is selectively registerable with the complementary member to lock the front arm with respect to the chair frame.

BRIEF DESCRIPTION OF THE DRAWINGS

The invention will now be described with reference to the drawings wherein.

DESCRIPTION OF THE PREFERRED EMBODIMENT

Figure 1:
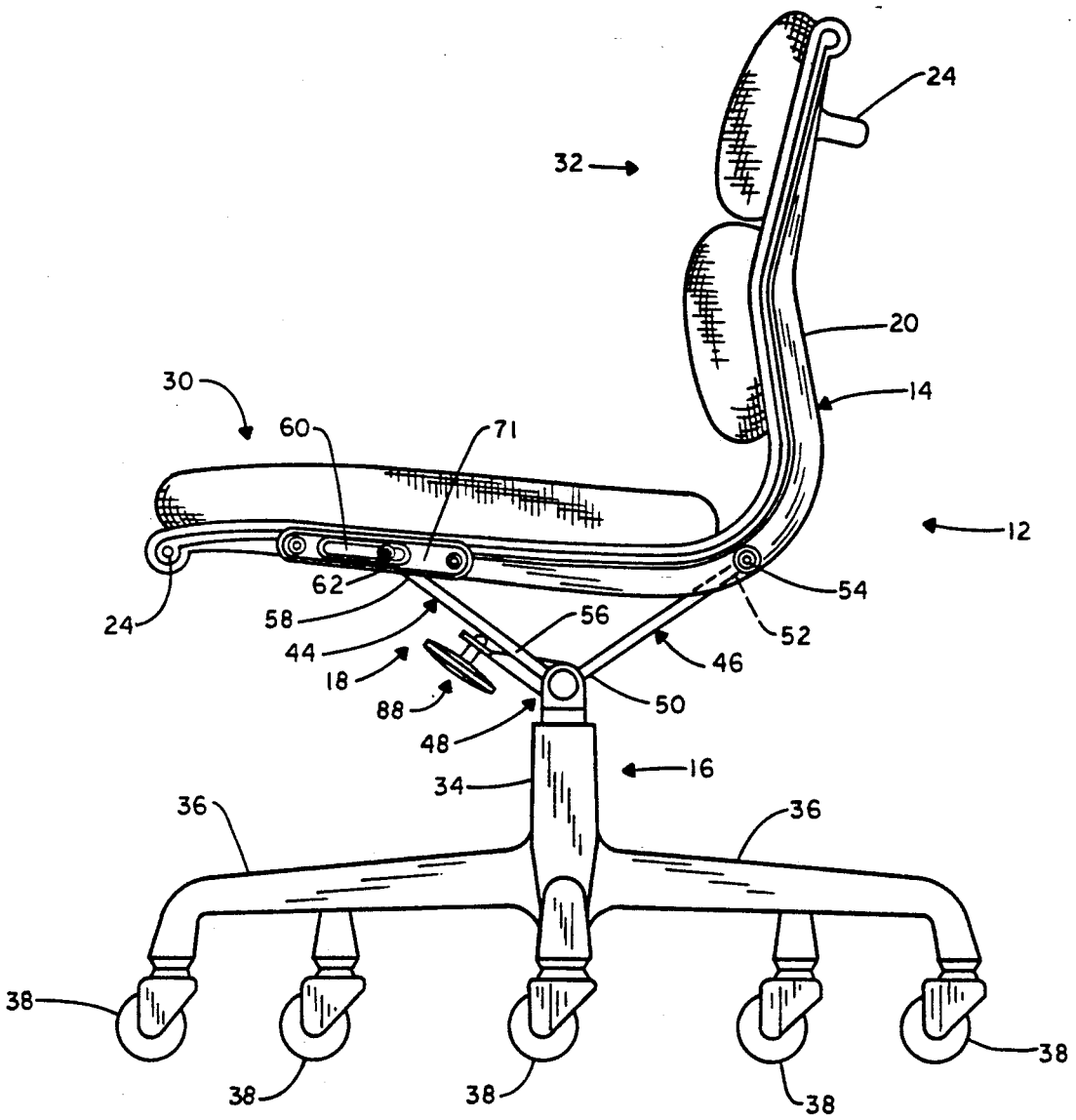
FIG. 1 is a side elevational view of a chair incorporating a locking tilt mechanism according to the invention.

Turning now to the drawings, and more particularly to FIG. 1, a chair 12 is seen which comprises a chair frame 14, a base 16 and a tilt mechanism 18. The chair frame 14 comprises a pair of opposed side frames, a left side frame 20 and a right frame 22 (FIG. 2) and one or more spreaders 24 to maintain the side frames, 20 and 22, in a fixed, spaced relationship. In the preferred embodiment, two spreaders 24 are used to space the side frames 20 and 22, one at the top of the backrest and the other at the front of the seat of the chair 12. As will be described further below, the tilt mechanism 18 also helps maintain the side frames 20 and 22 in a spaced relationship.

The chair frame 14 supports a seat portion 30 and a backrest portion 32. In the preferred embodiment, the side frames 20 and 22 are rigid and maintain the seat 30 and backrest 32 in a fixed relationship with respect to each other. Alternatively, the chair frame 14 can be easily modified to permit pivotable movement of the backrest 32 relative to the seat 30. For example, a pivot can be incorporated in the chair frame 14 between the seat 30 and backrest 32 such that the backrest 32 may pivot relative to the seat 30.

The base 16 of the chair 12 comprises a vertical support post 34 and a plurality of legs 36 which extend radially from the vertical support post 34. Casters 38 can be mounted at the terminal end of the legs 36 to permit sliding movement of the chair 12 or, alternatively, conventional glides (not shown) may be used.

The tilt mechanism 18 comprises a cantilevered front support arm 44, a cantilevered back support arm 46 and a torsion bar mechanism 48. The back support arm 46 has a lower end 50 attached to the torsion bar mechanism 48 and an upper end 5 attached to the opposed side frames 20 and 22. The front support arm 44 has a lower end 56 attached to the torsion bar mechanism 48 and an upper end 58 attached to the opposed side frames 20 and 22.

The torsion bar mechanism 48, in conjunction with the front and back support arms 44 and 46, provide resistance to tilting of the chair. The torsion bar mechanism 48 comprises a torsion bar 68, a bearing sleeve 70, an inner sleeve 72 and an outer sleeve 74. The torsion bar is conventional in design, i.e. a first end of the torsion bar is fixedly mounted whereas a second end is rotatable about the longitudinal axis of the bar.

In the torsion bar mechanism 48 according to the invention, the torsion bar 68 is circumferentially surrounded by the inner sleeve 72 which is in turn circumferentially surrounded by the bearing sleeve 70, which is in turn circumferentially surrounded by outer sleeve 74. Preferably, the torsion bar 68 is manufactured from spring steel and the inner sleeve 72 and outer sleeve 74 are manufactured of a strong durable product such as steel. The bearing sleeve 70 is preferably thin compared to the inner and outer sleeves, 72 and 74, and is constructed of a suitable silicone plastic or nylon material which permits rotation of the torsion bar 68 and inner sleeve 72 relative to the outer sleeve 74.

Figure 5:
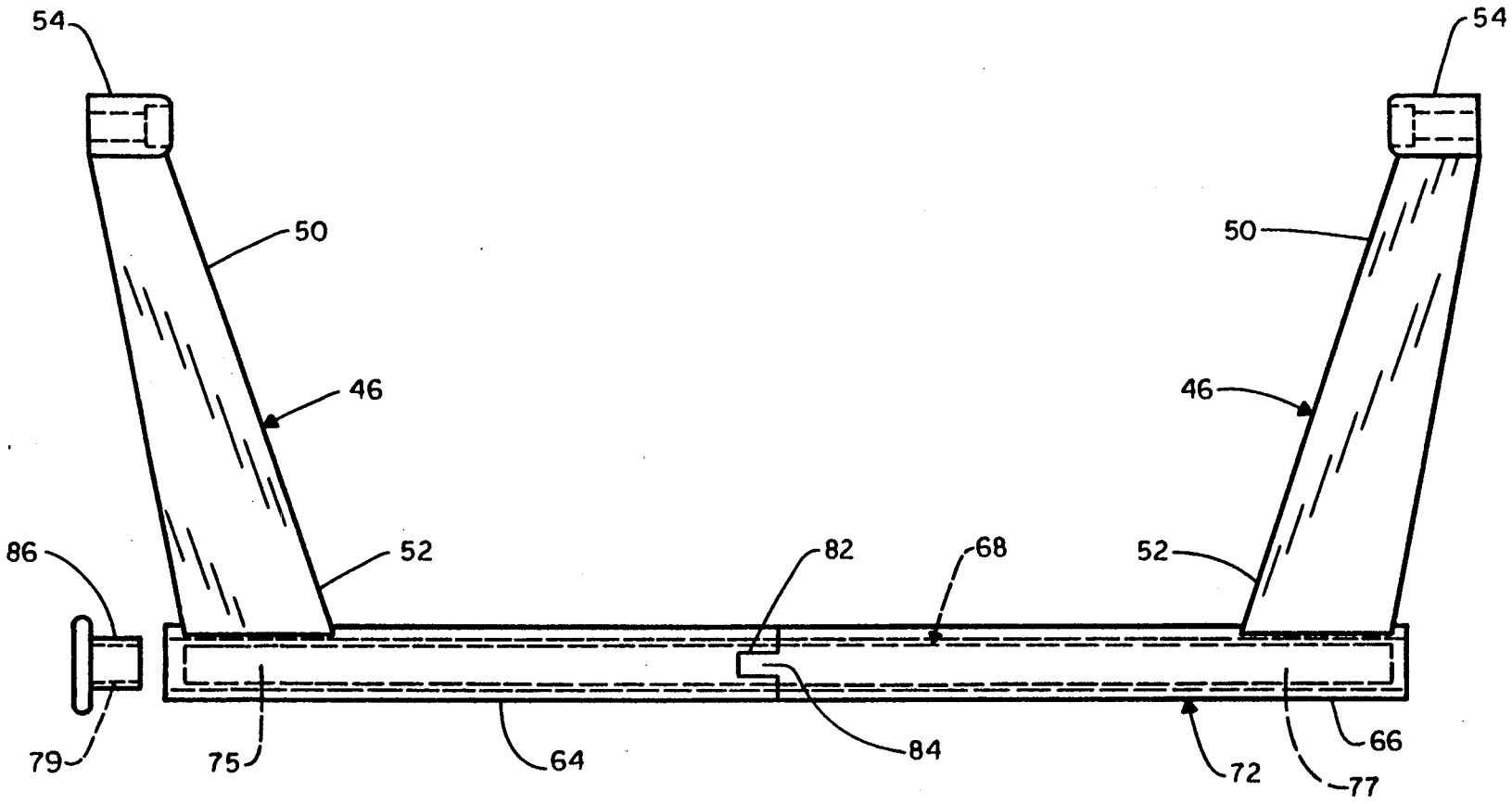
FIG. 5 is a rear elevational view of the rear arms and split inner sleeve of the torsion bar mechanism.

As seen in FIG. 5, the inner sleeve 72 is preferably constructed of two separate, interlocking members, a left member 64 and a right member 66. The left member 64 has a groove 82 at one end which receives a tongue 84 mounted to one end of the right member 66. The interlocking engagement of the left member 64 and the right member 66 create a unitary inner sleeve 72. The separation of the inner sleeve 72 into the left and right members, 64 and 66, facilitates insertion of the inner sleeve 72 within the outer sleeve 74 after the back support arms 46 are fixedly attached thereto, as described further below.

Figure 4:
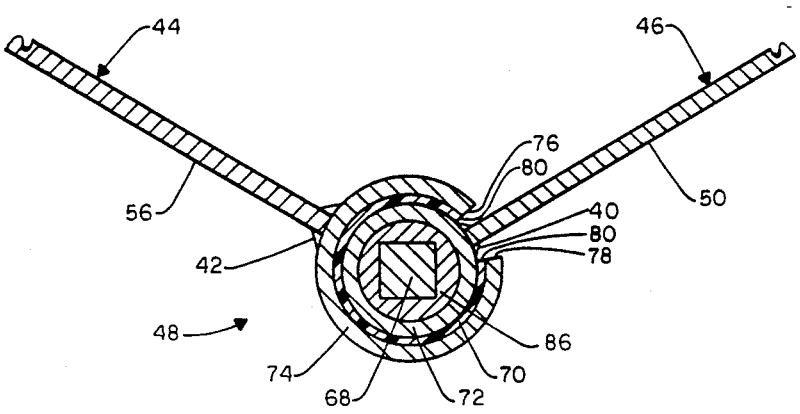
FIG. 4 is a partial sectional view taken along lines 4—4 of FIG. 2 of the torsion bar mechanism.

As seen in FIGS. 4 and 5, a first end 75 of the torsion bar 68 is fixedly attached to the left member 64 of the inner sleeve 72 by a mounting plug 86. The mounting plug 86 is telescopically received within the end of left member 64 and fixedly attached thereto by suitable means such as welding. The plug incorporates an aperture 79 which telescopically receives the first end 75 of the torsion bar 68. The aperture 79 has a cross section complementary to the cross section of the torsion bar 68 such that the first end 75 of the torsion bar 68 is tightly received within the plug 86 thereby preventing movement or rotation of the first end 75 of the torsion bar 68 relative to the inner sleeve 72. The second end 77 of the torsion bar 68 is rotatable within inner sleeve 72.

The outer sleeve 74 is fixedly attached to the top of the support post 34 by suitable means such as welding.

The front and back support arms, 44 and 46 are attached to the torsion bar mechanism 48. As seen in FIGS. 1-4, the lower end 50 of back support arm 46 is fixedly attached to the inner sleeve 72 by suitable means such as a weld bead 40. The lower end 50 passes through an opening 76 in the outer sleeve 74 and an opening 78 in the bearing sleeve 70. The lower end 56 is fixedly attached to the outer sleeve 74 by suitable means such as weld bead 42. According to this arrangement, the back support arms 46 can rotate about the central axis of the torsion bar 68 relative to the front support arms 44.

The tilt mechanism 18 of the chair 12, according to the invention, permits tilting movement of the backrest 32 and the rear portion of the seat 30 without the undesirable lifting movement of the front portion of the seat 30. The front portion of the seat 30 slides generally along a horizontal plane. This horizontal movement is made possible by the unique configuration of the tilt mechanism 18.

Figure 2:
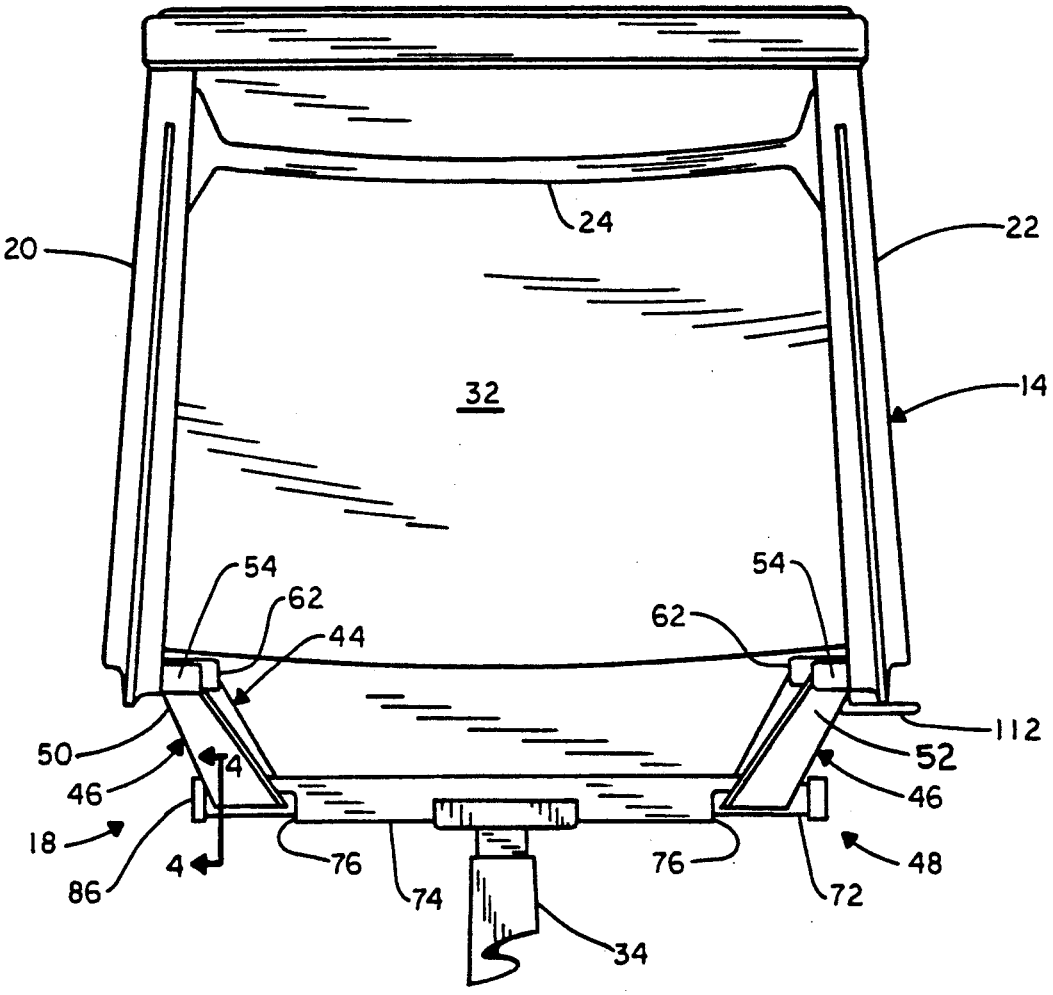
FIG. 2 is a rear elevational view of a chair incorporating a locking tilt mechanism according to the invention.
Figure 3:
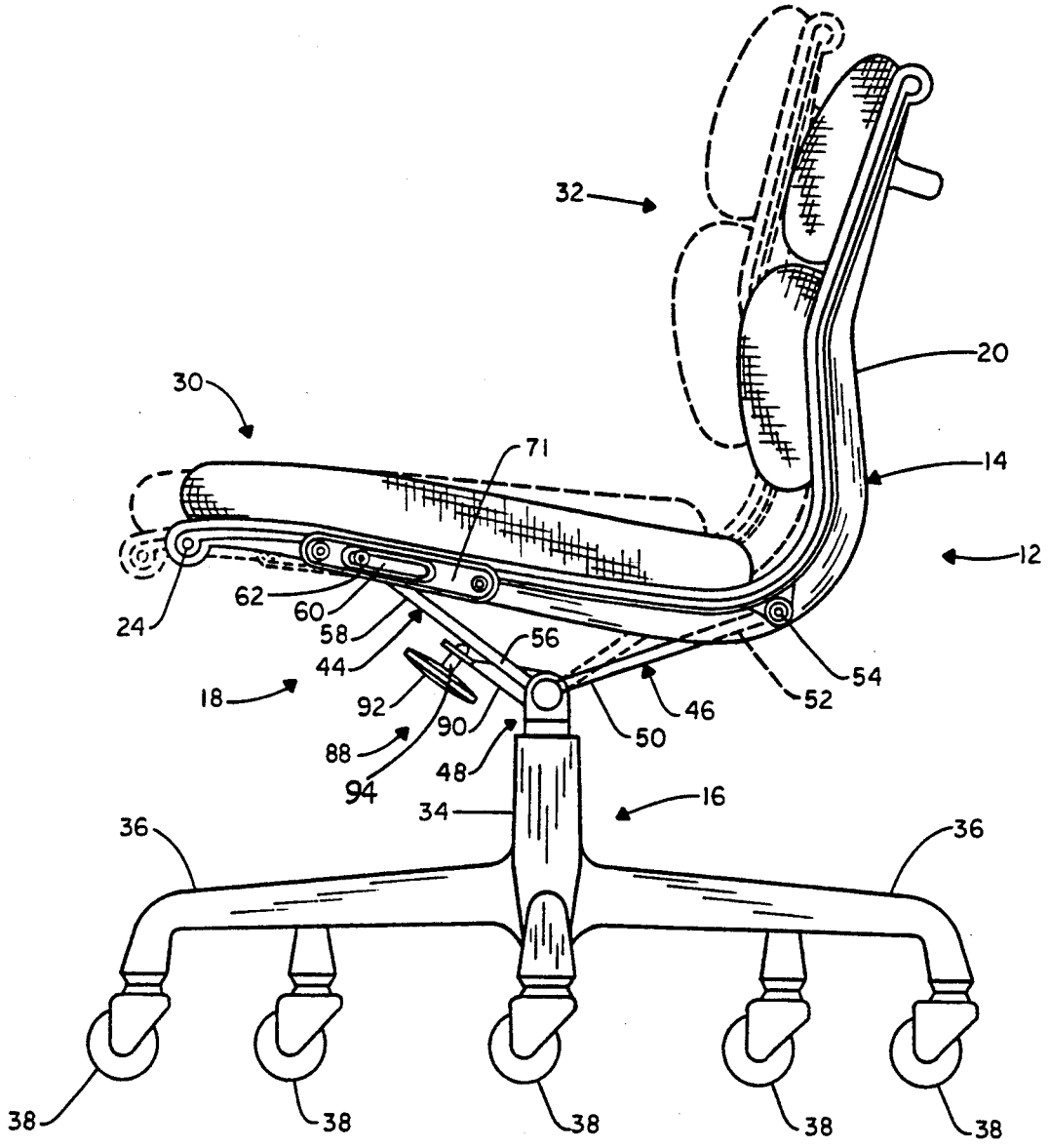
FIG. 3 is a side elevational view of a chair incorporating the tilt mechanism according to the invention in the reclined state with the upright state shown in phantom lines.

As seen in FIGS. 1-3, the upper end 52 of the back support arm 46 is pivotably attached to the side frames 20 and 22 at pivot point 54. The upper end 58 of the front support arm 44 is pivotably and slidably mounted in an elongated opening 60 of the side frames 20 and 22 at pivot points 62. More specifically, a right side rack 69 is fixedly attached to the right side frame 22 and receives the pivot point 62 in the elongated opening 60. Similarly, a left side rack 71 is fixedly attached to the left side frame 20 and receives the pivot point 62 in the elongated opening 60. A suitable nylon bearing (not shown) or the like may be used at the pivot points 54 and 62 to provide free movement of the front and back support arms, 44 and 46, relative to the chair frame 14.

Preferably, the nylon bearing is manufactured from a product DELRIN, manufactured by The DuPont Co.

In operation, as the occupant tilts back in the chair 12, the upper end 52 of the back support arm 46 pivots downward about the axis of the torsion bar 68. As noted above, the lower end 50 of the back support arm 46 is fixedly attached to the inner sleeve 72 which is in turn attached to one end of the torsion bar 68, therefore the pivoting movement of the back support arm 46 is resisted by the spring rate of the torsion bar 68.

The lower end 56 of front support arm 44 is fixedly attached to the outer sleeve 74 which is in turn fixedly mounted to the base 16. Therefore, as the back support arm 46 pivots about the axis of the torsion bar 68, the front support arm 44 does not pivot. Movement of the chair frame 14 relative to the front support arm 44 is accomplished through the slidably mounted pivot point 62 within the elongated openings 60. As seen in FIG. 1, when the chair is in the fully upright position, pivot point 62 is at or near the rear edge of the elongated opening 60. As the user reclines in the chair, the front of the seat portion 30 of the chair frame 14 moves generally along a horizontal plane until the chair reaches its maximum reclined position, i.e. when the pivot 62 abuts the front edge of the elongated opening 60. In the preferred embodiment, the back support arm 46 pivots about an arc approximately 17° from its fully upright position to the fully reclined position while the front of the seat portion 30 slides generally along a horizontal plane. This fully reclined state is shown in FIG. 3 and the upright position is shown in phantom lines.

Preferably, the tilt mechanism 18 incorporates a tension control device 88 for varying the resistance to reclining movement supplied by the torsion bar 68. The tension control device 88 comprises a lever arm 90 and an adjustment handle 92. One end of the lever arm 90 is fixedly attached to the rotating or second end 77 of the torsion bar 68. A threaded shaft 94 is threadably mounted in the other end of the lever arm 90. The adjustment handle 92 is mounted on one end of the threaded shaft 94 and the other end of the shaft abuts the front support arm 44.

In operation, the tension control device 88 varies the pretension of the torsion bar 68 by rotation of the torsion bar 68 through rotation of the lever arm 90. The lever arm 90 is rotated about the axis of the torsion bar 68 by rotation of the adjustment handle 92 and threaded shaft 94. By turning of the adjustment handle 92, the lever arm 90 is rotated about the axis of the torsion bar 68. As the lever arm 90 rotates, the movable end of the torsion bar 68 also rotates relative to the fixed end. This rotation of the torsion bar 68 varies the pretension of the bar 68.

As seen in FIGS. 6–13, the tilting mechanism 18 further comprises a locking mechanism. A first embodiment of the locking mechanism 100 comprises a pivotably mounted locking bar 102, a movable gripping member 104, the right side rack 69, a mounting member 108 and a high pitch screw 110. In the preferred embodiment, the locking mechanism 100 is mounted to the right side frame 22, however it could easily be reversed and mounted to the left side frame 20.

The locking bar 102 is pivotably mounted at pivot 62 to the upper end 58 of the right front support arm 44. In light of this mounting position, the locking bar is immediately adjacent the elongated opening 60 of the right side rack 69 and the right side frame 22. A handle 112 is incorporated on one end of the locking bar 102 and extends laterally outwardly such that the occupant of the chair 12 may easily grasp the handle 112 when seated.

Figure 7:
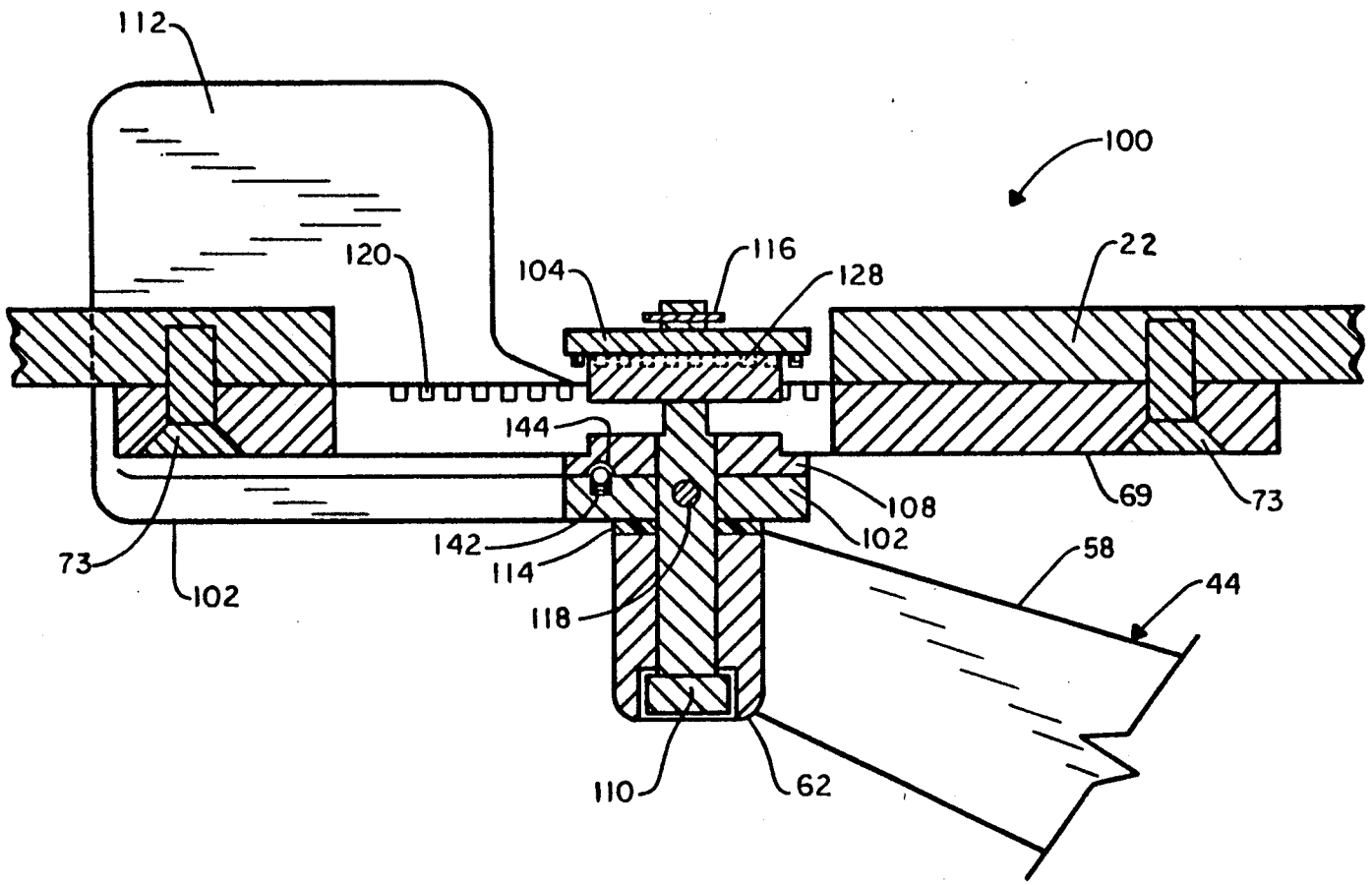
FIG. 7 is a partial sectional view of the locking bar mechanism taken along lines 7—7 of FIG. 6.
Figure 8:
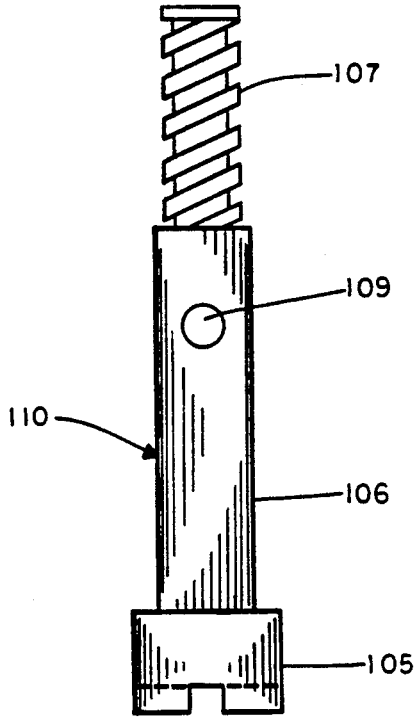
FIG. 8 is a top plan view of the high pitch screw.

As seen in FIGS. 7 and 8, a high pitch screw 110 passes through the pivot axis of the pivot point 62 mounted at the upper end 58 of the front support arm 44. The high pitch screw 110 comprises a head 105, a circular shank 106, a threaded end 107 and a pin aperture 109. When the locking mechanism 100 is assembled, the high pitch screw 110 is mounted in the pivot point 62 and passes through a washer 114, the locking bar 102, the mounting member 108, and the gripping member 104. A C-clip 116 is mounted on the end of the high pitch screw 110 to retain each of these elements on the screw 110. The washer 114 is mounted on the shank 106 between the pivot point 62 and the locking bar 102. The washer 114 is manufactured of a suitable material such as nylon to permit pivotable movement of the pivot point 62 relative to the locking bar 102.

The locking bar 102 is also mounted on the shank 106 of the screw 110. The locking bar 102 is mounted adjacent the pin aperture 109. A pin 118 passes through an appropriate opening (not shown) in the locking bar 102 into the pin aperture 109 of the high pitch screw 110. The pin serves to mount the screw 110 to the locking bar 102 such that rotation of the locking bar 102 about the axis of the screw 110 causes rotation of the screw 110.

The mounting member 108 is also mounted on the shank 106 of the high pitch screw 110 immediately adjacent the locking bar 102. The gripping member 104 is threadably mounted on the threaded end 107 of the high pitch screw 110. In operation, the occupant manipulates the handle 112 of the locking bar to cause rotation of the locking bar 102 and the high pitch screw 110 about the longitudinal axis of the screw 110. This rotation causes the threadably mounted gripping member 104 to move along the threaded end 107 of the high pitch screw thereby bringing the gripping member 104 into and out of engagement with the rack 69.

Figure 9:
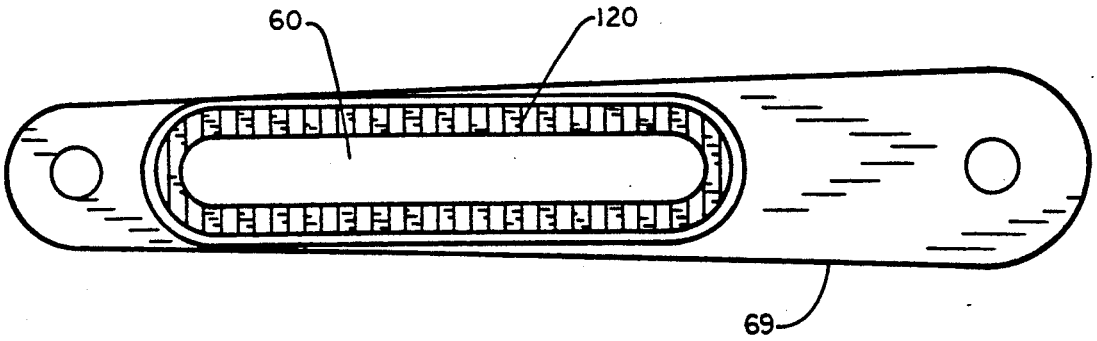
FIG. 9 is a side elevational view of the rack.

As seen in FIGS. 7 and 9, the rack 69 has a plurality of teeth 120 formed around the perimeter of the elongated opening 60 on the outboard side of the rack 69.

Figure 10:
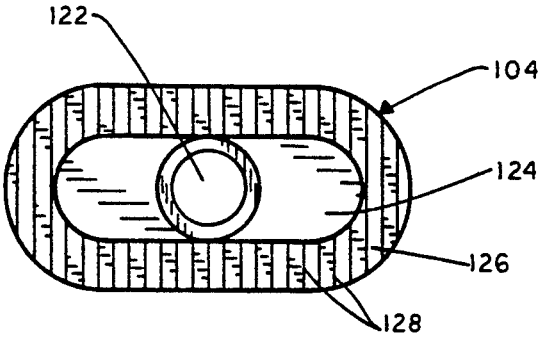
FIG. 10 is a side elevational view of the movable gripping member.
Figure 11:
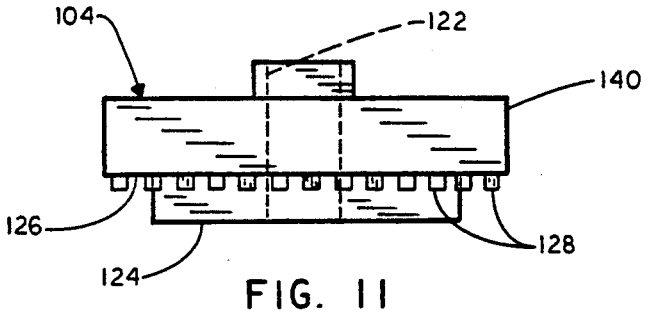
FIG. 11 an overhead view of the movable gripping member as seen in FIG. 10.

As seen in FIGS. 10 and 11, the gripping member 104 elliptically shaped. It comprises an threaded opening 122, a raised mounting surface 124, and a gripping surface 126. The threaded opening 122 receives the high pitch screw 110 as noted above. The mounting surface 124 is elliptically shaped and is received within the elongated opening 60. The short diameter of the elliptically shaped mounting surface 124 is nominally less than the short diameter of the elongated opening 60 such that the mounting surface is slidably received within the elongated opening 60. The short diameter of the elliptically shaped gripping surface 126 is greater than the short diameter of the elongated opening such that the gripping surface is not received within the elongated opening 60. Rather the gripping surface 126 abuts the teeth 120 of the rack 69. The gripping surface 126 has complementary teeth 128 formed thereon. The teeth 128 of the gripping surface cooperate with the teeth 120 of the rack 69 such that the gripping member 104 can selectively frictionally engage the rack 69 in response to rotation of the high pitch screw 110. The elliptical shape of the mounting surface 124 permits sliding movement of the gripping member 104 within the elongated opening 60 when the gripping member 104 is rotated away from the rack 69, but does not permit the gripping member 104 to rotate relative to the rack 69.

Figure 12:
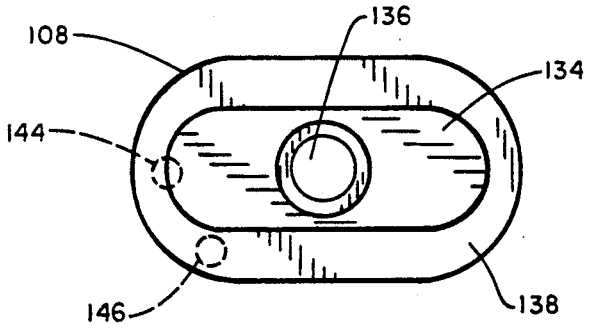
FIG. 12 is a side elevational view of the lock mechanism mounting member.
Figure 13:
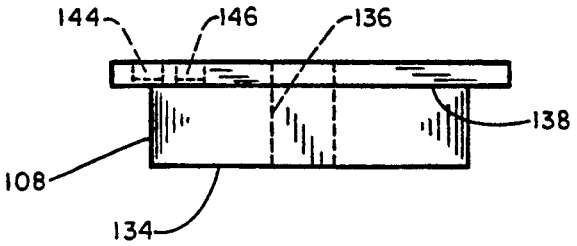
FIG. 13 is a top plan view of the mounting member as seen in FIG. 12.

As seen in FIGS. 12 and 13, the mounting member 108 is similar in elliptical configuration to the gripping member 104 and similarly permits sliding movement of the mounting member 108 within the rack but prohibits rotation thereof. The mounting member 108 comprises a raised mounting surface 134, an unthreaded opening 136 and an outer surface 138. The mounting surface 134 is elliptically shaped such that the short diameter is nominally less than the short diameter of the elongated opening 60 of rack 69. This permits the mounting member 108 to be slidably received within the elongated opening, but prevents the mounting member from rotating relative to the rack 69. The screw opening 136 is dimensioned to receive the shank 106 of the high pitch screw 110.

Figure 6:
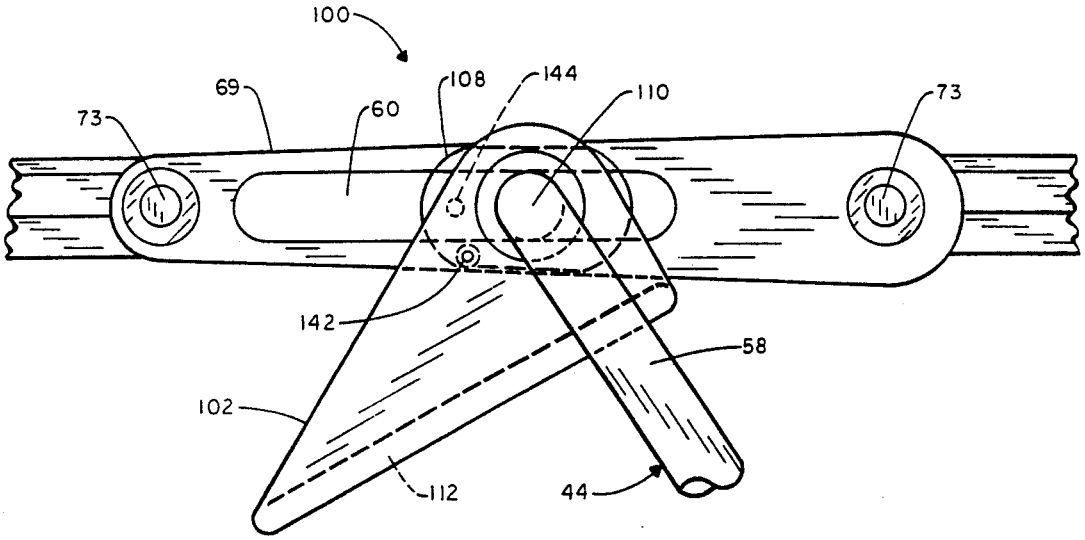
FIG. 6 is a side elevational view of a first embodiment of the locking bar mechanism according to the invention.

In operation, the locking mechanism 100 serves to selectively lock the chair 12 in a multitude of reclined positions ranging from the fully upright position as seen in FIG. 1 to the fully reclined position, as seen in FIG. 3, and any point in between. The locking mechanism 100 prevents tilting movement of the chair 12 by preventing the sliding movement of the pivot point 62 within the elongated opening 60 of the racks 69 and 71. Locking of the chair is accomplished through movement of the locking bar 102. In the unlocked position, the locking bar is pivoted downward, as seen in FIG. 6, in this position, the teeth 120 of the rack 69 are not engaged with the teeth 128 of gripping member 104, as seen in FIG. 7. The user may tilt the chair to the desired position and then lock the chair in this position by lifting on the handle 112. Rotation of the handle 112 and locking bar 102 about the axis of the high pitch screw 110 causes the screw 110 to similarly rotate because of the pinned connection. The rotation of the screw 110 causes the gripping member 104 which is threadably mounted on the high pitch screw 110 to move along the axis of the high pitch screw 110 until the gripping surface 126 of the gripping member 104 engages the teeth 120 of the rack 69. The frictional engagement between the gripping member 104 and the rack 69 prevent the sliding movement of the pivot point 62 within the elongated opening 60 and thereby preventing further tilting movement of the chair.

The locking mechanism 100 further includes means to lock the locking bar 102 in the locked or the unlocked position. As seen in FIGS. 6, 7 and 9, the locking bar 102 further comprises a spring mounted ball plunger 142. The ball plunger 142 is mounted on the surface of the locking bar 102 which abuts the mounting member 108. The ball plunger 142 is selectively received in a first detent 144 or a second detent 146 on the abutting surface of the mounting member 108. The first detent 144 is located on approximately the same horizontal plane as the longitudinal axis of the high pitch screw 110. When spring ball plunger 142 is received within this detent 144, the handle 112 is substantially horizontal and the threadably mounted gripping member 104 is not engaged with the rack 69 as seen in FIG. 7. In this position, the locking mechanism is unlocked and the occupant may freely tilt the chair forward and back against the bias supplied by the torsion bar mechanism 48.

The second detent 146 is located on an arc about the central axis of the screw such that as the locking bar 102 is rotated about the longitudinal axis of the high pitch screw 110, the spring mounted ball plunger 142 will engage the second detent 146. The second detent 146 is mounted at the point where the rotation of the high pitch screw 110 causes the gripping member 104 to frictionally engage the teeth 120 of the rack 69, thereby locking the chair in the current tilted or upright position.

The use of the spring mounted ball plunger 142 and cooperating detents, 144 and 146, permits the occupant to lock the chair in the unlocked or locked position. The chair will maintain this locked or unlocked state until the user applies sufficient force to the locking bar 102 overcome the spring bias of the spring mounted ball plunger 142 and pivot the locking bar 102 from one detent to the other.

Figure 14:
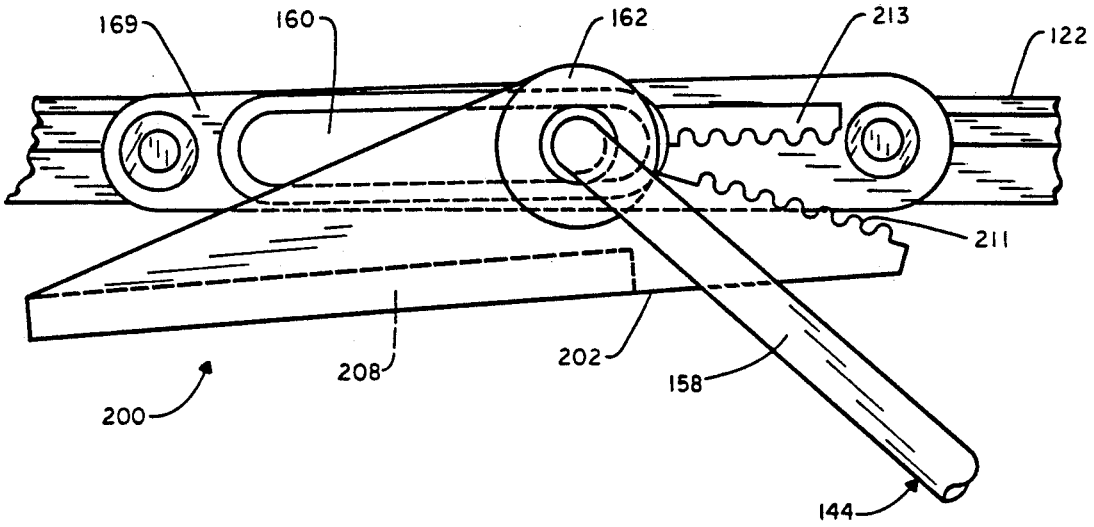
FIG. 14 is side elevational view of a second embodiment of the locking bar mechanism according to the invention.

FIG. 14 shows a second embodiment of the locking mechanism. In this second embodiment, reference numerals which are analogous to numerals in the first embodiment has been increased by 100.

The locking mechanism comprises a pivotably mounted locking bar 202, at least one engaging tooth 211 on the locking bar 202, and a complementary member 213 cooperable with the at least one engaging tooth 211.

Similar to the first embodiment, the locking bar 202 of the second embodiment is pivotably mounted at pivot point 162 to the upper end 158 of one of the front support arms 144. The locking bar 202 is immediately adjacent the elongated opening 160 on the right side frame 122. A handle 208 is incorporated on one end of the locking bar 202 and the engaging teeth 211 are integrally molded on the other end of the locking bar 202.

Complementary member 213, which is cooperable with the engaging teeth 211, is fixedly attached to or integrally molded with the right side rack 169. The complementary member 213 is immediately adjacent to the elongated opening 160. The complementary member 213 is arranged such that it extends inwardly a short distance from the right side frame 22. With this arrangement, the engaging teeth 211 of the locking bar 202 may be pivoted into and out of cooperable engagement with the complementary member 213. By pushing down on the handle 208, the locking bar 202 pivots about the pivot axis of the pivot point 162, thereby lifting the engaging teeth 211 into cooperable engagement with the complementary member 213. Conversely, by lifting the handle 208, the locking bar 202 pivots about the pivot axis of the pivot point 62, thereby lowering the engaging teeth 211 out of engagement with the complementary member 213.

The locking mechanism 200 of the second embodiment, permits the chair to be selectively locked in a multitude of reclined positions ranging from the fully upright position, as seen in FIG. 1, to the fully reclined position, as seen in FIG. 3, and any point in between. For example, if the occupant desires to lock the chair 112 in a certain position, the occupant would recline the chair to the desired position and then push down on the handle 208 thereby engaging the teeth 211 and the complementary member 213. With the teeth 211 and complementary member 213 engaged, the pivot point 162 may not slide within the elongated opening 160, thereby preventing adjustment of the relative tilt of the chair.

To unlock the chair 112, the occupant would lift up on handle 208, thereby pivoting the teeth 212 out of engagement with the complementary member 213. Thereafter, the occupant could alter the chair to any desired position and once again push down on handle 208 to engage the teeth 211 and the complementary member 213.

The locking mechanism according to the invention permits the user to lock the chair in a reclined position and rest comfortably, the user does not have to resist the tilting bias of the torsion bar mechanism to maintain this reclined position. The locking mechanism according to the invention incorporated on a chair with the above described sliding tilt mechanism has the added benefit of avoiding the undesirable effect of the lifting of the front edge of the seat portion as the chair reclines.

While particular embodiments of the invention have been shown, it will be understood, of course, that the invention is not limited thereto since modifications may be made by those skilled in the art, particular in light of the foregoing teachings. Reasonable variation and modification are possible within the foregoing disclosure of the invention without departing from the scope of the invention.

The embodiments of the invention in which an exclusive property or privilege is claimed are defined as follows:

1. In a chair comprising:
a base;
a chair frame for supporting a seat and a backrest;
an elongated opening in said frame near the front edge of a seat portion thereof; and
a tilt mechanism mounted between said base and said chair frame for tilting movement of the seat and backrest relative to the base, said tilt mechanism including means to bias the chair frame to an upright position, at least one front support arm which is fixedly mounted at a lower end to the base and at an upper end is both slidably and pivotably mounted in said elongated opening in the frame, and a back support arm having a lower end pivotally mounted to the base and an upper end pivotally mounted to the frame; and
a locking mechanism between said front support arm and the chair frame to selectively lock said chair frame in one of several tilted positions.

2. A chair according to claim 1 wherein said bias means comprises a torsion bar which is mounted to the top of the base to resist tilting movement of the seat and backrest relative to the base wherein said torsion bar comprises a first end which is fixedly attached to said base and a second end which is coupled to said chair frame.

3. A chair according to claim 2 wherein said bias means further comprises;
an inner sleeve which circumferentially surrounds the torsion bar;
a bearing sleeve which circumferentially surrounds the inner sleeve; and
an outer sleeve which is fixedly attached to the base and circumferentially surrounds the bearing sleeve wherein said first end of the torsion bar is fixedly attached to said inner sleeve and said second end of the torsion bar is rotatable relative to the inner sleeve.

4. A chair according to claim 2 wherein said lower end of said back support arm is fixedly mounted to the second end of the torsion bar.

5. A chair according to claim 4 wherein said tilt mechanism further comprises;
an inner sleeve which circumferentially surrounds the torsion bar;
a bearing sleeve which circumferentially surrounds the inner sleeve; and
an outer sleeve which is fixedly attached to the base and circumferentially surrounds the bearing sleeve wherein said first end of the torsion bar is fixedly attached to said inner sleeve and said second end of the torsion bar is rotatable relative to the inner sleeve.

6. A chair according to claim 5 wherein one end of the front support arm is fixedly attached to the outer sleeve.

7. A chair according to claim 2 wherein said tilt mechanism further comprises a tension control lever which is fixedly attached to the second end of the torsion bar to vary the tension of the torsion bar necessary to tilt the seat and backrest relative to the base.

8. A chair according to claim 1 wherein said locking mechanism further comprises;
a locking bar pivotably mounted to said front support arm;
a rotatable screw fixedly attached to said locking bar;
a rack with an aperture through which the screw passes;
a first set of teeth on a surface of said rack;
a gripping member which is threadably mounted on said screw adjacent the first set of teeth;
a second set of teeth on a surface of said gripping member which are cooperable with said first set of teeth on said rack;
whereby rotation of said locking bar causes rotation of said screw which in turn causes movement of the threadably mounted gripping member relative to said rack such that the first and second set of teeth are selectively engaged; when engaged, the upper end of said front support arm is prevented from sliding within the elongated opening of said frame thereby preventing tilting movement of said chair and when not engaged the upper end of said front support arm is slidable within the elongated opening of said frame permitting tilting movement of said chair.

9. A chair according to claim 8 wherein said screw has high pitch treads incorporated thereon.

10. A chair according to claim 8 further comprising a mounting member with an aperture through which said screw passes wherein said mounting member is mounted adjacent said locking bar.

11. A chair according to claim 10 further comprising a cooperating spring ball plunger mounted on one of said locking bar or mounting member and at least one cooperable detent for selectively receiving said ball plunger mounted on the other of said locking bar or mounting member.

12. A chair according to claim 8 wherein said screw is fixedly attached to said locking bar by a pin which is received in a first pin aperture in said screw and a second pin aperture in said locking bar.

13. A chair according to claim 1 wherein said locking mechanism further comprises;
a locking bar pivotably mounted to one of said front support arm or chair frame;
at least one engaging tooth on the locking bar; and
a complementary member which is cooperable with said at least one tooth and is mounted to the other of said front support arm or said chair frame and adjacent said locking bar so that said at least one engaging tooth is selectively registerable with said rack to lock said front arm with respect to the chair frame.

14. In a chair comprising;

a base;

a chair frame for supporting a seat and a backrest;

an elongated opening in said frame near the front edge of a seat portion thereof; and a tilt mechanism mounted between said base and said chair frame for tilting movement of the seat and backrest relative to the base, said tilt mechanism including means to bias the chair frame to an upright position and at least one front support arm which is fixedly mounted at a lower end to the base and at an upper end which is both slidably and pivotably mounted in said elongated opening in the frame;

the improvement comprising;

at least one back support arm which is mounted between said biasing means and said chair frame wherein a lower end of said back support arm is fixedly mounted to the biasing means and an upper end is mounted to the frame.

15. A chair according to claim 14 wherein said bias means comprises a torsion bar which is mounted to the top of the base to resist tilting movement of the seat and backrest relative to the base wherein said torsion bar comprises a first end which is fixedly attached to said base and a second end which is fixedly attached to said back support arm.

16. A chair according to claim 15 wherein said bias means further comprises:

an inner sleeve which circumferentially surrounds the torsion bar;

a bearing sleeve which circumferentially surrounds the inner sleeve; and an outer sleeve which is fixedly attached to the base and circumferentially surrounds the bearing sleeve wherein said first end of the torsion bar is fixedly attached to said inner sleeve and said second end of the torsion bar is rotatable relative to the inner sleeve.

17. A chair according to claim 14 wherein said tilt mechanism further comprises a locking mechanism between said front support arm and the chair frame to selectively lock said seat and backrest in one of several tilted positions.

18. A chair according to claim 14 wherein said tilt mechanism further comprises a tension control lever which is fixedly attached to the second end of the torsion bar to vary the tension of the bar necessary to tilt the seat and backrest relative to the base.

19. A chair according to claim 14 wherein said locking mechanism further comprises;

a locking bar pivotably mounted to said front support arm;

a rotatable screw fixedly attached to said locking bar;

a rack with an aperture through which the screw passes;

a first set of teeth on a surface of said rack;

a gripping member which is threadably mounted on said screw adjacent the first set of teeth;

a second set of teeth on a surface of said gripping member which are cooperable with said first set of teeth on said rack;

whereby rotation of said locking bar causes rotation of said screw which in turn causes movement of the threadably mounted gripping member relative to said rack such that the first and second set of teeth are selectively engaged; when engaged, the upper end of said front support arm is prevented from sliding within the elongated opening of said frame thereby preventing tilting movement of said chair and when not engaged the upper end of said front support arm is slidable within the elongated opening of said frame permitting tilting movement of said chair.

20. A chair according to claim 19 wherein said screw has high pitch treads incorporated thereon.

21. A chair according to claim 19 further comprising a mounting member with an aperture through which said screw passes wherein said mounting member is mounted adjacent said locking bar.

22. A chair according to claim 21 further comprising a cooperating spring ball plunger mounted on one of said locking bar or mounting member and at least one cooperable detent for selectively receiving said ball plunger mounted on the other of said locking bar or mounting member.

23. A chair according to claim 19 wherein said screw is fixedly attached to said locking bar by a pin which is received in a first pin aperture in said screw and a second pin aperture in said locking bar.

24. A chair according to claim 14 wherein said locking mechanism further comprises;

a locking bar pivotably mounted to one of said front support arm or chair frame;

at least one engaging tooth on the locking bar; and a complementary member which is cooperable with said at least one tooth and is mounted to the other of said front support arm or said chair frame and adjacent said locking bar so that said at least one engaging tooth is selectively registerable with said rack to lock said front arm with respect to the chair frame.

* * * * *